US005597991A

United States Patent [19]

Chen et al.

[11] Patent Number: 5,597,991

[45] Date of Patent: Jan. 28, 1997

[54] ENCLOSED ELECTRICAL POWER DISCONNECT SWITCHES AND CIRCUIT BREAKER

[75] Inventors: Hai Chen; George W. Evans, Jr., both of Salisbury; Leo V. Zirpoli, Berlin, all of Md.

[73] Assignee: Eaton Corporation, Cleveland, Ohio

[21] Appl. No.: 497,305

[22] Filed: Jun. 30, 1995

[51] Int. Cl.[6] ..... H01H 9/20

[52] U.S. Cl. ..... 200/50.02; 200/50.1; 200/50.12

[58] Field of Search ..... 200/50 R, 50 A, 200/50 B, 50 AA, 50 C, 50.01–50.4, 17 R

[56] References Cited

U.S. PATENT DOCUMENTS

| | | | |
|---|---|---|---|
| 793,872 | 7/1905 | Bissing | 200/50 A X |
| 1,328,606 | 1/1920 | White | 200/50 A |
| 1,366,466 | 1/1921 | Kermode | 200/50 A |
| 1,424,407 | 8/1922 | Helske | 200/50 A |
| 1,499,996 | 7/1924 | Oberlander | 200/50 A |
| 1,553,354 | 9/1925 | Baxter | 200/50 A |
| 1,599,764 | 9/1926 | Heller | 200/50 A |
| 1,642,870 | 9/1927 | Butte | 200/50 A |
| 2,204,002 | 6/1940 | Roew | 200/50 A X |
| 2,650,331 | 8/1953 | Clark | 361/643 |
| 3,175,126 | 3/1965 | Hardwick | 361/616 |
| 3,179,762 | 4/1965 | Swinney | 200/50 A |
| 3,264,443 | 8/1966 | Farina et al. | 200/50 A X |
| 3,633,075 | 1/1972 | Hawkins | 361/616 |
| 3,649,790 | 3/1972 | Friedrich et al. | 218/86 |
| 3,896,353 | 7/1975 | Burton et al. | 361/609 |
| 3,997,749 | 12/1976 | Hanagan | 200/318.1 |
| 4,296,284 | 10/1981 | Lott | 200/48 R |
| 4,484,046 | 11/1984 | Neuhouser | 218/3 |
| 4,541,033 | 9/1985 | Saito | 361/602 |
| 5,270,500 | 12/1993 | Guiney | 200/17 R |

*Primary Examiner*—J. R. Scott
*Attorney, Agent, or Firm*—Loren H. Uthoff, Jr.

[57] ABSTRACT

An electrical power switch assembly has a disconnect switch electrically connected to a circuit breaker mounted within an enclosure having a hinge cover where the disconnect switch has a movable element that opens and closes electrical contacts. The movable element is pivotably connected to the cover using a switch link such that the opening of the cover causing the switch link to pull the movable element causing the electrical contacts to open. A breaker link that extends outside the enclosure is used to activate and deactivate the circuit breaker.

2 Claims, 2 Drawing Sheets

FIG 3
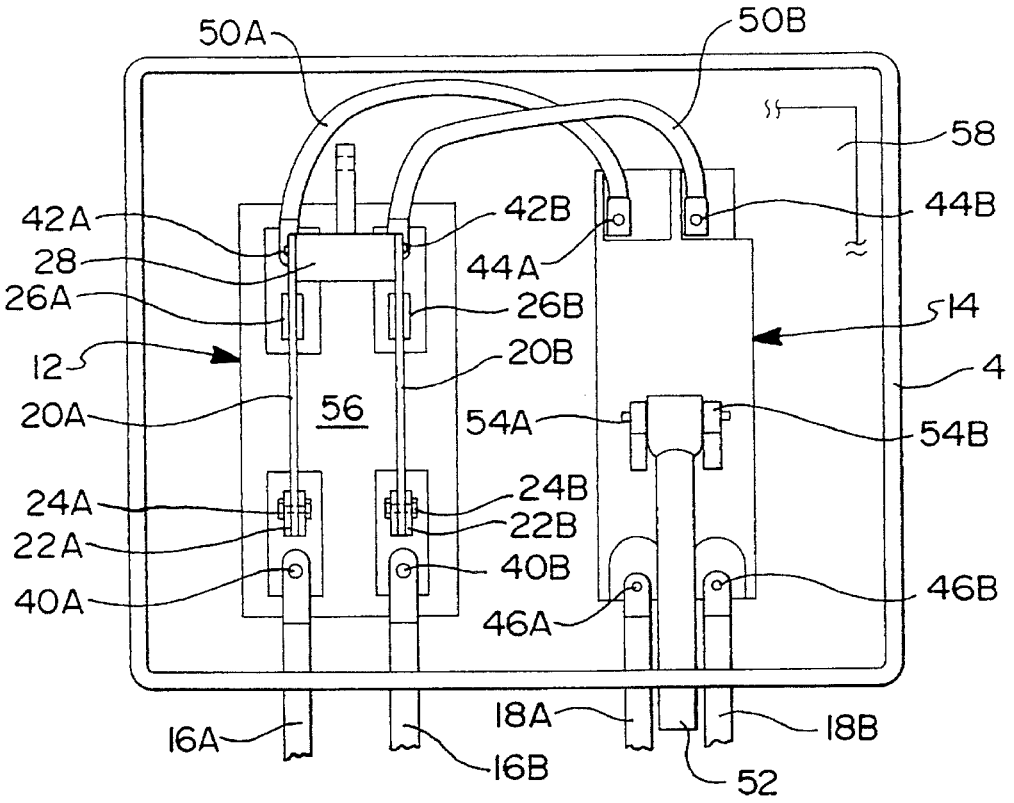
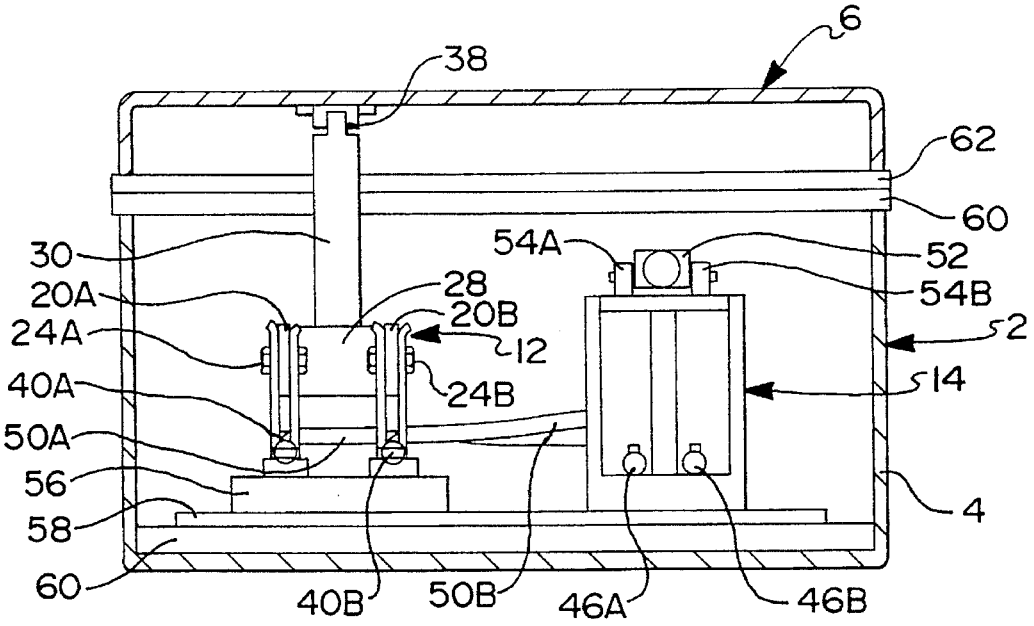
FIG 4

ENCLOSED ELECTRICAL POWER DISCONNECT SWITCHES AND CIRCUIT BREAKER

BACKGROUND OF THE INVENTION

1. Field of the Invention

The present invention relates generally to high voltage switches and more particularly to high voltage switches where a circuit breaker is connected in series with a disconnect switch mounted in an enclosure.

2. Description of the Prior Art

High voltage transmission line systems are necessarily provided with power switching means for connecting or disconnecting the transmission lines from a source of power to a load. The power switching means commonly takes the form of a circuit breaker which is adapted to automatically break a circuit when a fault is sensed, and a disconnect switch, such as a knife switch, which is connected in series between the circuit breaker and the load. Unlike a circuit breaker, a knife switch is not adapted to repeatable break a high voltage circuit but can be used to isolate the load from the transmission line to allow for maintenance. Due to the high electrostatic potentials involved, the switches are commonly substantial in size and mounted within an enclosure such as a cabinet and various safety devices are used to terminate power within the enclosure prior to or upon opening for maintenance.

Knife switches commonly comprise a movable blade or arm controlled by a linkage which may be operated manually, or by electric, pneumatic or hydraulic means. Ordinarily the elements of the switch are exposed, the movable blade portion being pulled free of engagement with the stationary contact portion and swinging through a large arc to effect opening of the switch. Such a disconnect switch is commonly known in the art as a "knife" switch. An example of a knife switch is shown in U.S. Pat. No. 4,541,033, the disclosure of which is hereby incorporated by reference.

Enclosures have been utilized to physically protect the circuit breaker and the knife switch where a mechanical latching mechanism is used to open the knife switch to disconnect the circuit breaker from the input power transmission line. Such an arrangement is shown in U.S. Pat. No. 3,896,353 the disclosure of which is hereby incorporated by reference. The mechanical latching mechanism simultaneously unlatches an access door to the enclosure and operates the knife switch to isolate the circuit breakers and other elements within the enclosure from the transmission line so that maintenance can be safely effectuated.

SUMMARY OF THE INVENTION

The present invention relates to an improved high voltage circuit breaker and knife switch power switch assembly for mounting within an enclosure having a hinged cover which has improved safety during servicing of the load apparatus. The high voltage circuit breaker is operated external to the enclosure with a breaker activation arm. The knife switch is mechanically connected to the enclosure cover through a linkage where the opening of the enclosure cover causes the knife switch to open thereby further isolating the load from the input power transmission line.

The knife switch operates between a closed position in which it connects the circuit breaker with a set of high voltage lines and an opened position in which the circuit breaker is isolated from the high voltage lines. A knife switch in the preferred embodiment is used to provide the function of a disconnect switch in the present invention. A four bar linkage is used to provide the function of opening the knife switch as the cover to the enclosure is opened and closed. Thus, if the cover is opened, a positive, visually apparent, linkage opens the knife switch thereby providing for increased safety by visibly assuring that the input power transmission lines are disconnected from the load prior to servicing the load.

One provision of the present invention is to provide a linkage to operate a knife switch mounted in an enclosure to provide a visually apparent open position of the circuit upon opening the enclosure.

Another provision of the present invention is to provide a linkage to operate a knife switch to a visually apparent open position where the knife switch is mounted in an enclosure and the linkage is connected at one end to an enclosure cover and another end attached to the knife switch.

Another provision of the present invention is to provide a linkage to operate a knife switch to a visually apparent open position where the knife switch is electrically connected to a circuit breaker, both of which are mounted in an enclosure.

Still another provision of the present invention is to provide a knife switch electrically connected to a circuit breaker both mounted within an enclosure where the knife switch is operated through a four bar linkage connected to a hinged enclosure cover.

The foregoing and other objects and advantages of the invention will appear from the following description. In the description reference is made to the accompanying drawings which form a part hereof, and in which there is shown by way of illustration a preferred embodiment of the invention.

BRIEF DESCRIPTION OF THE DRAWINGS

FIG. 1 is a cross-sectional view of the power switch assembly of the present invention with the enclosure cover in a closed position;

FIG. 3 is a top cross-sectional view of the power switch assembly of the present invention with the enclosure cover removed; and FIG. 4 is a back cross-sectional view of the power switch assembly of the present invention.

DETAILED DESCRIPTION OF THE PREFERRED EMBODIMENT

Figure 2:
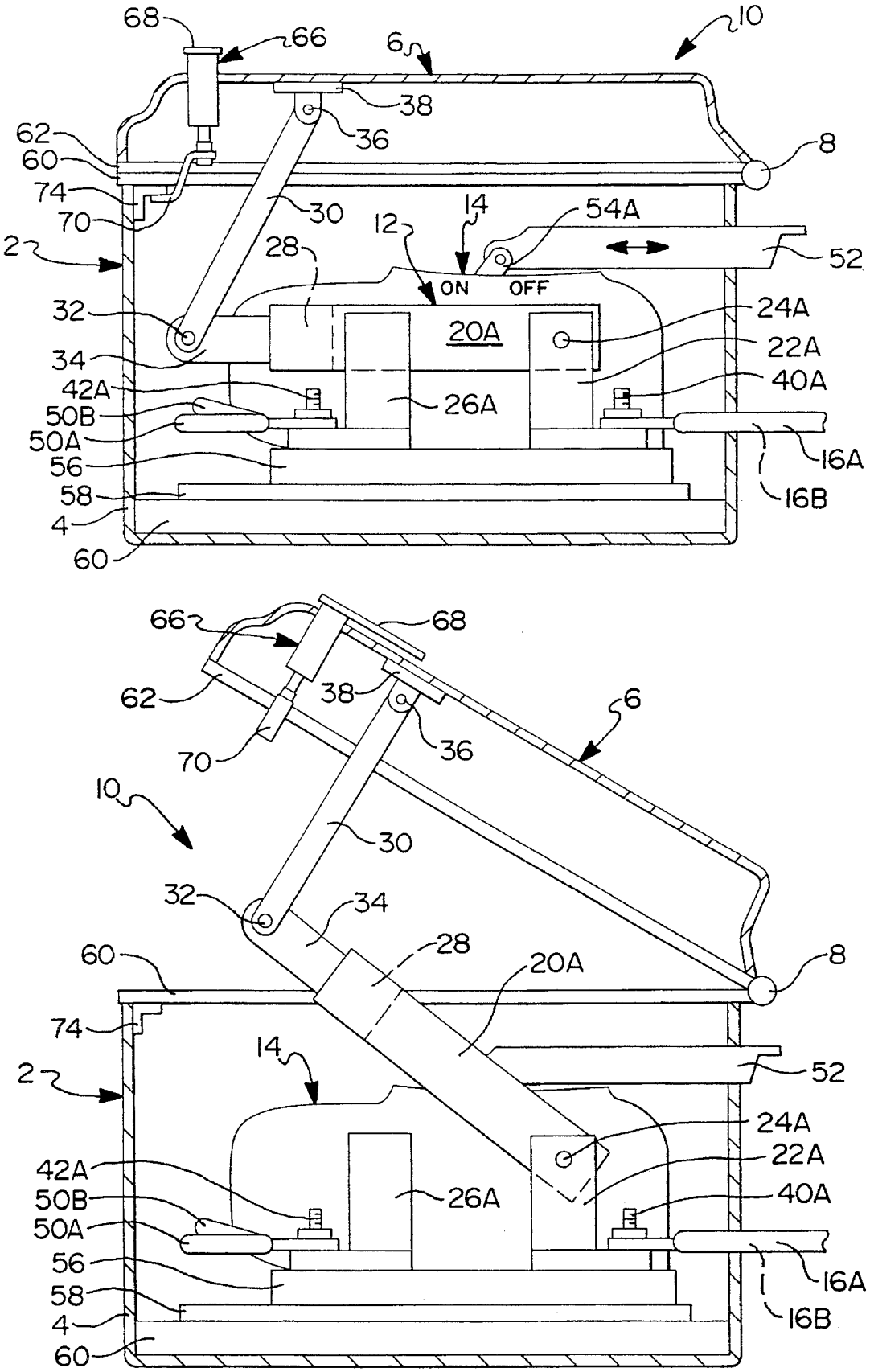
FIG. 2 is a cross-sectional view of the power switch assembly of the present invention with the enclosure cover in an open position.

As shown in FIG. 1, an enclosure 2 is formed having a main section 4 and an enclosure cover 6 which is attached to the main section 4 by hinge 8. The electrical contactor/breaker 10 of the present invention is comprised of an electrical circuit breaker 14 electrically connected to a disconnect switch 12 both of which are contained within the enclosure 2. The enclosure 2 consists of a main housing 4 which contains the electrical components and the cover 6 is pivotably connected to the main housing 4 by a hinge 8 and opens to expose the electrical components for installation, inspection and servicing.

The disconnect switch 12 is shown in the preferred embodiment as what is known in the art as a "knife" switch although any type of mechanically actuated switching device could be used which lends itself to control through a linkage attachment to the enclosure cover 6. The disconnect switch 12 is connected to a source of electrical power through connectors 16A and 16B while the circuit breaker 14 is electrically connected to the disconnect switch 12 with connectors 50A and 50B and to a load center, such as a motor or power distribution network through connectors 18A and 18B, all of which are more clearly shown in FIG. 3. Disconnect switch 12 is comprised of a knife blade 20A which is rotatably connected to a base contactor 22A with fastener pin 24A and is opened and closed so as to disengage and engage stationary contact 26A by pivoting on fastener pin 24A.

Referring once again to FIG. 1, an breaker link 52 which is axially moved by an operator, is connected to on/off breaker levers 54A and 54B so as to cause the circuit breaker 14 to be turned on when power is required and to be preferably turned off prior to the opening of the enclosure 2.

Generally, mounting plates 56, 58 and 60 are used to support and electrically isolate the disconnect switch 12 and the circuit breaker 14 from the enclosure 2. The mounting plate 56 supports and is part of the disconnect switch 12 and is made from an electrical insulator material. Mounting plate 58 extends to cover the majority of the bottom of the enclosure 2 thereby providing a mounting surface for both the mounting plate 56 and the circuit breaker 14. Normally the mounting plate 58 is also made of an electrical insulator material although other materials both conducting or non-conducting can be used. Mounting plate 60 can be a layer that covers the total bottom surface of the enclosure 2 or it can consist of a plurality of post standoffs which serve to mechanically connect and support the mounting plate 58 to the enclosure 2.

Enclosure flange 60 provides for sealing against the cover flange 62 where the enclosure flange 60 is attached to the main housing 4 and the cover flange 62 is attached to the cover 6. A cover lock assembly 66 is used to lock the cover 6 closed with the rotation of the lever 68 which causes the lock extension 70 to engage the lock jam 74 thereby preventing the cover 6 from being opened as shown in FIG. 1.

FIG. 1 illustrates the positioning of a switch link 30 and knife blade 20A when the enclosure cover 6 is in a closed position while FIG. 2 illustrates the positioning of the switch link 30 and the knife blade 20A when the enclosure cover 6 is in an open position. The switch link 30 is connected to the cover 6 at one end and to the knife blades 20A and 20B through spacer block 28 so as to form a four-bar linkage with the hinged cover 6. Thus, as the cover 6 is moved, the switch link 30 moves the knife blades 20A and 20B to an open or closed position.

FIG. 2 illustrates a cross-sectional view of the contactor/breaker 10 of the present invention with the circuit breaker 14 open and the disconnect switch 12 open. The cover 6 has been opened after rotation of the cover lock assembly 66 to an unlocked position by rotation of the lever 68 so that the lock extension 70 no longer engages the lock jam 74. Formed to the spacer block 28 is an extension arm 34 which is attached to the switch link 30 with pin link 32. The opposite end of the switch link 30 is attached to the enclosure cover 6 with a pin 36 which engages attachment plate 38 which is attached to the enclosure cover 6. Cotter pins can be used to retain the pin 36 and the pin link 32 in position. The disconnect switch 12 and the circuit breaker 14 are attached to the mounting plate 58 which is attached to the bottom of the main housing 4. Upon opening the cover 6, the switch link 30, which is rotatably attached to the cover 6 at attachment plate 38 with pin 36, at one end and attached at an opposite end to spacer block 28 at its extension arm 34 with pin 32, is displaced so as to cause the disconnect switch 12 to open thereby confirming the interruption of electrical power from the connectors 16A and 16B to the circuit breaker 14 (which has been previously opened by movement of the breaker link 52 inward). The present invention provides for a mechanical switch link 30 from the cover 6 to the knife blades 20A and 20B through a spacer block 28 which serves as a visual confirmation that the electrical power has been interrupted as soon as the cover 6 is opened to any significant extent.

Now referring to FIG. 3, a top cross-sectional view of the electrical contactor/breaker 10 of the present invention is shown with the cover 6 removed. Two knife blades 20A and 20B are shown and are joined by spacer block 28 which functions to allow the knife blades 20A and 20B to be moved simultaneously by a switch link 30 which is moved by the opening and closing of the enclosure cover 6 (see FIGS. 1 and 2). The spacer block 28 joins the free ends of the knife blades 20A and 20B of the disconnect switch 12 which is shown as a knife switch. Each knife blade 20A and 20B pivots on respective fastener pins 24A and 24B so as to electrically connect and disconnect the base stationary contactors 22A and 22B from the respective base stationary contactors 26A and 26B. The spacer block is connected to the switch link 30 by pin link 32 as illustrated in FIGS. 1, 2 and 4. The disconnect switch 12 includes a mounting plate 56 which is attached to the mounting plate 58. The disconnect switch 12 is serially, electrically connected to the circuit breaker 14 through terminals 42A and 42B on the disconnect switch 12 and terminals 44A and 44B on the circuit breaker 14. Terminal 42A is connected to terminal 44A with electrical connector 50A while terminal 42B is connected to terminal 44B using connector 50B.

The circuit breaker 14 disconnect switch 12 is connected to electrical connectors 18A and 18B which supply electrical power and to connectors 50A and 50B which serve to electrically connect the disconnect switch 12 to the circuit breaker 14. The connectors 18A and 18B serve to electrically connect the input side of the circuit breaker 14 to a power supply center. Electrical power is introduced to the electrical disconnect switch 12 of the present invention through connectors 50A and 50B into terminals 42A and 42B respectively. Knife blades 20A and 20B electrically connect terminals 42A and 42B to terminals 40A and 40B which are in turn connected to electrical connectors 16A and 16B respectively for connection to a load center such as a motor or a power distribution network.

The circuit breaker 14 is activated and deactivated upon axial movement of breaker link 52 which is connected to switch levers 54A and 54B such that movement breaker of levers 54A and 54B by the axial displacement of breaker link 52 cause the circuit breaker 14 to activate or deactivate thereby electrically connecting or disconnecting the input terminals 46A and 46B from the output terminals 44A and 44B.

The breaker link 52 has a colored end opposite the end connected to the circuit breaker 14 to better alert the maintenance personnel with the state of the circuit breaker 14 where visual recognition of the color indicates that the circuit breaker 14 is turned off.

FIG. 4 is a cross-sectional view of the electrical contactor/breaker 10 of the present invention where the back side of the main housing 4 has been removed to show the contactor 12 and the circuit breaker 14 and especially the switch link 30. Also, the cover lock assembly 66 is not shown. The switch link 30 is pivotably attached at one end to attachment plate 38 and at another end to the spacer block 28. Opening the enclosure cover 6 causes the disconnect switch 12 to be opened by action of the switch link 30 causing both knife blades 20A and 20B to rotate on fastener pins 24A and 24B respectively to electrically disconnect the output terminals 40A and 40B from the input terminals 42A and 42B.

Also shown is the breaker link 52 which is pinned to both switch levers 54A and 54B of the circuit breaker 14. As the breaker link 52 is moved, the breaker levers 54A and 54B switch the circuit breaker 14 on and off so as to electrically connect the output terminals 44A and 44B to the input terminals 46A and 46B respectively.

Thus, by using a switch link 30 connected to the enclosure cover 6 to mechanically open and close the disconnect switch 12, and using an external breaker link 52 to turn the circuit breaker 14 on and off, a method of providing a dual visual circuit disconnect verification is effectuated. The present invention provides for increased maintenance safety by providing a mechanical linkage to a disconnect (knife) switch 12 where the state of the knife switch 12 can be visually confirmed once the enclosure cover 6 has been opened. If the disconnect switch 12 is open, then the load has been isolated from the power supply irrespective of the state of the circuit breaker 14. Also, the colored end of the breaker link 52 controlling the state of the circuit breaker 14 provides additional visual confirmation as to the power connect or disconnect status of the electrical contactor/breaker 10 of the present invention. Most importantly, the load center will be disconnected from the power source as soon as the enclosure cover 6 is opened and this can be visually confirmed by the maintenance person.

Although this invention has been described in its preferred form with a certain degree of particularity, it is understood that the present disclosure of the preferred form has been made only by way of example in that numerous changes in the details, construction, combination and arrangement of parts may be resorted to without departing from the spirit and the scope of the invention as here and now claimed.

What is claimed is:

1. An electrical power switch assembly comprising:

an enclosure having a main housing and a cover hinged to said main housing;

a disconnect switch mounted within said main housing, said disconnect switch having a moveable element for closing and opening electrical contacts contained within said disconnect switch;

a switch link connected at a first end to said moveable element and connected at a second end to said cover disposed to open said disconnect switch as said cover is opened;

a circuit breaker electrically connected to said disconnect switch, said circuit breaker opening an internal electrical contact when a breaker lever is moved in one direction to deactivate said circuit breaker and closing said internal electrical contact when said breaker lever is moved in an opposite direction to activate said circuit breaker;

a breaker link having a first end connected to said breaker lever and a second end extending outside of said enclosure for moving said breaker lever thereby activating or deactivating said circuit breaker.

2. The electrical power switch assembly of claim 1, wherein said second end of said breaker link has a relatively bright colored end portion.

* * * * *